United States Patent [19]

Stahlecker et al.

[11] Patent Number: 4,484,433

[45] Date of Patent: Nov. 27, 1984

[54] METHOD FOR MANUFACTURING A WRAPPED YARN, A WRAPPED YARN, AND AN APPARATUS FOR CARRYING OUT THE METHOD

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 447,102

[22] Filed: Dec. 6, 1982

[30] Foreign Application Priority Data

Dec. 10, 1981 [DE] Fed. Rep. of Germany ..... 3148940

[51] Int. Cl.[3] ..... D02G 3/28; D02G 3/04

[52] U.S. Cl. ..... 57/15; 57/6; 57/13; 57/16; 57/17; 57/18; 57/210; 57/315

[58] Field of Search ..... 57/3, 6, 12, 13–18, 57/315, 328, 330, 341, 344, 352, 908

[56] References Cited

U.S. PATENT DOCUMENTS

| | | | |
|---|---|---|---|
| 1,557,804 | 10/1925 | Cook | 57/18 X |
| 3,070,950 | 1/1963 | Thomas | 57/12 X |
| 3,367,095 | 2/1968 | Field | 57/204 X |
| 3,681,909 | 8/1972 | Korikovsky et al. | 57/18 X |
| 3,717,959 | 2/1973 | Chatin | 57/18 X |
| 4,219,998 | 9/1980 | Farnhill | 57/350 X |
| 4,418,523 | 12/1983 | Lemaire | 57/18 X |

*Primary Examiner*—Donald Watkins
*Attorney, Agent, or Firm*—Craig & Burns

[57] ABSTRACT

A method and apparatus for manufacturing a multi-component yarn as well as a multi-component yarn produced thereby, in which staple fibers and at least one endless yarn are combined with each other in a defined manner such that a wrapped yarn will result which purely externally has as far-reachingly as possible the properties of a pure staple fiber yarn; the sliver and the endless yarn or yarns are fed separately to a feed roller pair, are combined thereat travelling at the same velocity and parallel to one another, and are subsequently exposed together to a false twist and finally wrapped by a fine-count binding yarn; the predominantly nonvisible part of the wrapped yarn is constituted by the endless yarns which render the yarn bulky with relatively low material expenditure.

26 Claims, 4 Drawing Figures

METHOD FOR MANUFACTURING A WRAPPED YARN, A WRAPPED YARN, AND AN APPARATUS FOR CARRYING OUT THE METHOD

The present invention relates to a method for manufacturing a wrapped yarn, to the wrapped yarn produced thereby, and to an apparatus for carrying out the method, in which the wrapped yarn is made from a sliver and from at least one endless yarn and from a binding thread connecting the sliver and the endless yarn.

It is known from the U.S. Pat. No. 3,868,812 to feed two yarn components, which are designated as carrier yarn and effect yarn, by means of separate feed devices having different feed velocities to a hollow spindle, at the end of which is arranged a twist-imparting device and which carries a bobbin rotating in unison therewith and having a binding thread also guided through the hollow spindle and the twist device. The effect yarn or yarns, for which also endless yarns can be used, by reason of the greater feed velocity form effects in the shape of yarn loops so that an effect yarn results. In the case of an endless yarn fed as effect yarn, the latter does not combine with the carrier yarn consisting of a silver. The field of application of such effect yarns is limited.

For achieving an effect yarn with loop-like effects, it is also known (German Auslegeschrift No. 24 39 732) to feed a carrier yarn and an effect yarn by way of a common feed roller pair to a hollow spindle which carries a bobbin with a binding thread that is guided along through the hollow spindle and, together with the other two yarn components, travels through a twist device mounted at the end of the hollow spindle. The common feed roller pair is so constructed that the carrier yarn runs through the feed roller pair with slippage and therewith with increased velocity in order that the effect yarn can be fed with higher velocity so that loop-like effects are produced. This effect yarn is also suitable only for special application areas.

It is also known to produce a so-called stretch yarn (German Offenlegungsschrift No. 24 07 357) whereby a sliver, to which are admixed elastomer fibers in endless form, is fed to a hollow spindle which carries a bobbin with a binding thread rotating in unison therewith, which together with the sliver, runs through the hollow spindle, whereby the binding thread is to wrap spirally shaped about the sliver and the elastomer fibers. The sliver is to remain untwisted so that the fibers generally maintain their parallel position. In order to assure this, the hollow spindle is not provided with a false twist device. Instead, a suction device is connected to the spindle which is so constructed that the spindle is traversed in the travelling direction by an air stream. By reason of the fact that no twist is imparted, the manner of mixing of the sliver with the elastomer fibers is dependent on an independent preparatory operating process.

The present invention is concerned with the task to provide a method, by means of which the slivers or rovings and one or several endless yarns are connected with each other in a defined manner such that a wrapped yarn results that purely externally possesses as far-reachingly as possible the properties of a pure staple fiber yarn. The method according to the present invention essentially consists in that the sliver or roving and the endless yarn or yarns are combined travelling at the same velocity and parallel to one another, are subsequently exposed together to a false twist and are thereby wrapped by the binding yarn.

As a result of the parallel combining at the same velocity which, in practice, takes place by a clamping guide roller pair, the feed velocity for the sliver and the endless yarn or yarns becomes initially the same so that a wrapped yarn is produced without loop formation. The practice has thereby demonstrated that as a result of the common clamping, the endless yarns migrate into proximity of the axis of the resulting mixed yarn, which is considerably favored by the fact that the yarn components are exposed together to a false twist. The staple fibers thereby place themselves in the manner of a jacketing externally about the endless yarn or yarns which form the yarn core. The endless yarn or yarns are fed separately from the sliver prior to the combining operation so that the individual yarn components can also be prepared differently. Since the binding thread wrapping the yarn components possesses only a very small volume and weight proportion of the finished yarn, it does not impair the staple fiber-like character of the resulting wrapped yarn. The resulting wrapped yarn of staple fibers and endless yarns possesses a staple fiber-like appearance and staple fiber-like properties, which become effective in particular when the wrapped yarn is dyed in a further operating process. As is known, staple fibers, by reason of their good intimate mixing, can be dyed much more uniformly than endless threads or yarns, which lead to different dyed colors already with slight tensional deviations. The predominantly invisible part of the wrapped yarn is constituted by the endless yarns which—by reason of the fact that they may be curled or kinky—appear with a relatively slight material use nonetheless voluminous. The obtained wrapped yarn contains altogether with the same volume less material than a pure staple fiber yarn so that it can be manufactured considerably more economically. A particular field of application of the novel wrapped yarn resides in textiles for the home, especially in the manufacture of carpets.

The produced wrapped yarn consists as one rule of at least a relatively coarse filament yarn with spun-on staple fibers which are bound to the coarse filament yarn by a second finer filament thread or yarn, namely the binding thread. As a result thereof, the wrapped yarn appears on a display board more "textile", i.e., more hairy, and thus comes very close to a staple fiber yarn. The novel wrapped yarn possesses a particular bulkiness because the sliver and the endless yarn or yarns do not receive a real twist by the hollow spindle, but instead only a temporary false twist. The wrapped yarn is thus a far-reachingly twist-free combination kept together by a thin binding thread.

In an advantageous construction of the present invention, an apparatus for manufacturing the wrapped yarn according to the method of the present invention includes a feed device for a sliver or roving and at least one feed device for an endless yarn which are arranged ahead of a hollow spindle provided with a twist device—as seen in the direction of travel of the yarn components,—the hollow spindle carrying a bobbin with a binding thread rotating in unison therewith which together with the sliver and the endless yarn or yarns runs or travels through the hollow spindle toward a take-off device, whereby a common feed roller pair guiding and clamping the yarn components in unison, is arranged upstream of the hollow spindle as viewed in the travelling direction of the yarn components, which hollow spindle is provided with a twist device at its inlet.

In an appropriate construction of the apparatus according to the present invention, provision is made that a drafting unit having a preferably adjustable draft is arranged as feed device for the sliver upstream of the common feed roller pair, as viewed in the travelling direction of the yarn components. It is possible by an adjustment of the drafting unit to obtain a wrapped yarn with variable diameter without a resulting loop formation.

It is advantageous if a movement changing device for one or several of the yarn components is arranged upstream of the feed roller pair, as viewed in the travelling direction of the yarn components which changes the location of each yarn component as it passes through the guide roller pair. It can be prevented thereby that the endless yarn or yarns work themselves into the surface of the guide roller pair after a certain period of operation and form grooves.

In a further embodiment of the apparatus according to the present invention, a device for opening the endless yarn or yarns into individual filaments or filament groups is arranged upstream of the common feed roller pair, as viewed in the travelling direction of the endless yarn or yarns. Interstices are formed by the opening of the endless yarns, into which can penetrate the fibers or rovings so that a connection will be obtained between the staple fibers and the endless yarns.

These and other objects, features and advantages of the present invention will become more apparent from the following description when taken in connection with the accompanying drawing which shows, for purposes of illustration only, several embodiments in accordance with the present invention, and wherein.

Figure 1:
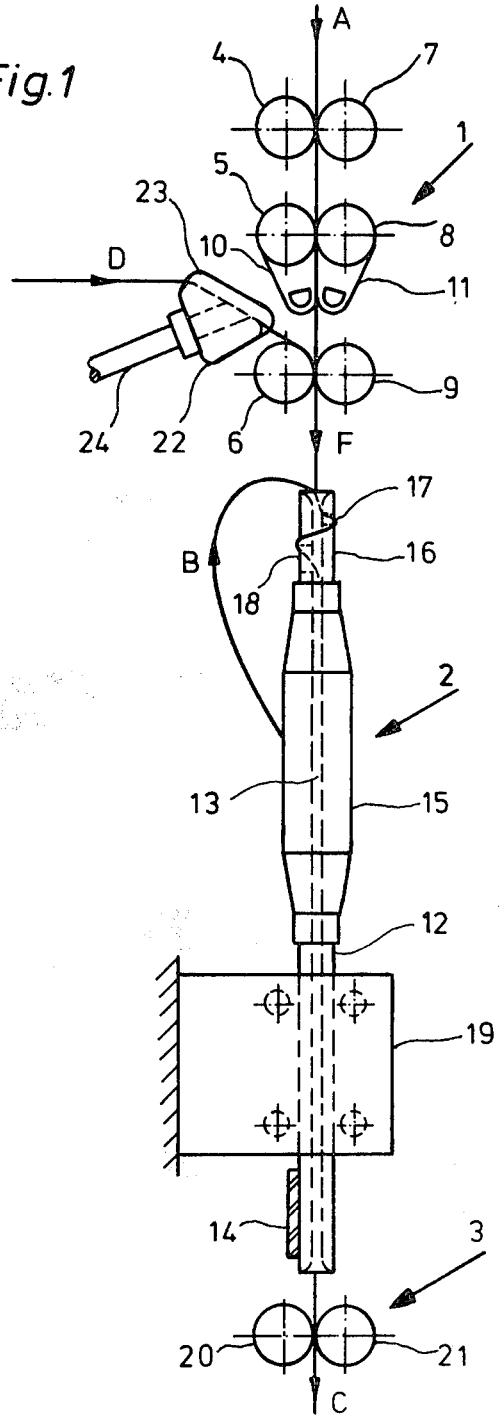
FIG. 1 is a somewhat schematic elevational view of a wrapped spinning aggregate for realizing the method in accordance with the present invention and having a pneumatic opening device for an individual yarn.

Referring now to the drawing wherein like reference numerals are used throughout the various views to designate like parts, the wrapped spinning aggregate of FIG. 1 includes a feed device generally designated by reference numeral 1 for a sliver or roving A which is fed to a twist device generally designated by reference numeral 2 and which is taken off by a take-off device generally designated by reference numeral 3. The feed device 1 consists of a drafting unit which includes lower rollers 4, 5 and 6 as well as upper rollers 7, 8 and 9 cooperating therewith, which are carried in a manner not illustrated in detail preferably by a common support and weighting arm that is adapted to be pivoted away from the bottom rollers 4, 5 and 6. The center bottom roller 5 and the center upper roller 8 are equipped with belt guidances 10 and 11. The bottom rollers 4, 5 and 6 are preferably constructed as cylinders extending continuously in the longitudinal direction of the machine whereas the upper rollers 7, 8 and 9 are coordinated to a respective spinning place, whereby customarily the upper rollers 7, 8 and 9 are supported pairwise with the upper roller of the adjacent spinning aggregate. The bottom rollers 4, 5 and 6 are customarily constructed as fluted or grooved cylinders whereas the upper rollers 7, 8 and 9 consist of metal rollers whose circumference is provided with a covering of plastic or rubber which is elastically yielding. The drive velocities of the bottom rollers 4, 5 and 6 increase in the feed direction of the sliver A, whereby appropriately the rotational differences are adjustable so that an adjustable draft is obtained for the sliver or roving.

The bottom roller 6 and the upper roller 9 serve as feed roller pair which is disposed facing the inlet of a hollow spindle 12 which is arranged in extension of the travelling direction of the sliver A and coaxially thereto and which forms the twisting device 2. The hollow spindle 12 includes within the area of the inlet, a twist device 16 operable to impart a false twist which consists of two bores 17 and 18 displaced diametrally opposite each other in relation to the axis of rotation and offset in the travelling direction. The hollow spindle 12 is supported on the machine frame in a bearing 19. The hollow spindle 12 extends beyond the bearing 19 and is driven by a tangential belt 14.

The hollow spindle 12 carries a bobbin 15 with a binding thread B rotating in unison therewith, for which a very fine endless thread can be used.

An endless yarn D is fed to the sliver A upstream of the feed roller pair, i.e., upstream of the bottom roller 6 and the upper roller 9 of the drafting unit, which is fed from the side of the stationary bottom roller 6. The endless yarn D is so added to the sliver or roving A that it is clamped and guided together with the sliver or roving A upstream of the guide roller pair 6 and 9. A guide element 22 is provided for the endless yarn D upstream of this guide roller pair 6, 9 which is delimited by an edge hemmer 23. The guide element 22 includes a compressed air nozzle 24 which is directed against the endless yarn D. The endless yarn D can be opened by this compressed air nozzle 24 into individual filaments (fibriles) or filament groups and can be fed in this opened condition to the guide roller pair 6 and 9. Since a feed of the endless yarn D to the guide rollers 6 and 9 is provided which is separate from the feed of the sliver A, a yarn tension suitable for the opening of the yarn D can be maintained within the area of the guide element 22, for example, by series-connecting a yarn brake ahead thereof, even though after the combining an identical feed velocity is obtained subsequently for the endless yarn D and the sliver A within the area of the guide roller pair 6, 9, which thereafter form a common yarn component F. As a result of the combining of the endless yarn D with the sliver A by a clamping guide roller pair 6, 9, a through-mixing of the two yarn components can readily be obtained, whereby the endless yarn D has the tendency to settle in the center of the resulting combined yarn component F.

The composite yarn component F is fed to the inlet of the central bore 13 of the hollow spindle 12, through the bore 17 toward the outside and subsequently through the bore 18 after looping the hollow spindle over an angle of about 180° again into the axial bore 13. In this manner, a false twist is produced in the composite yarn component F which extends from the twist device 16 up to the clamping place of the guide roller pair 6, 9 and which additionally assures a thorough mixing of the endless yarn D and of the sliver A, whereby the staple fibers place themselves essentially on the outside about the endless yarn D.

The binding thread B is also introduced into the inlet of the hollow spindle 12, which is also guided out of the bore 17 and into the bore 18 back into the axial bore 13 of the hollow spindle 12. The binding thread B wraps about the composite yarn component F. The wrapped yarn C produced by the composite yarn component F and the binding thread B is taken off at the lower end of the hollow spindle 12 by the take-off device 3 which consists of a take-off roller pair having rollers 20 and 21. Subsequently thereto, the wrapped yarn C is conducted to a winding device (not shown). The false twist produced by the twisting device 16 has again opened up when the wrapped yarn reaches the take-off roller pair 20, 21 so that a wrapped yarn C is obtained in which the staple fibers are placed far-reachingly nontwisted about the also nontwisted endless yarn D and are tied or bound together by the fine-count filament yarn B. The endless yarn D possesses a volumetric proportion of between about 45% and about 75% by weight whereas the binding thread B possesses a proportion of less than 5% by weight so that it practically is insignificant.

In the embodiment according to FIG. 1, the feed roller pair 6 and 9 is a component of a drafting unit for the sliver A. However, provision may also be made without difficulty that the feed roller pair is not a component of a drafting unit but is formed by additional structural parts.

Figure 2:
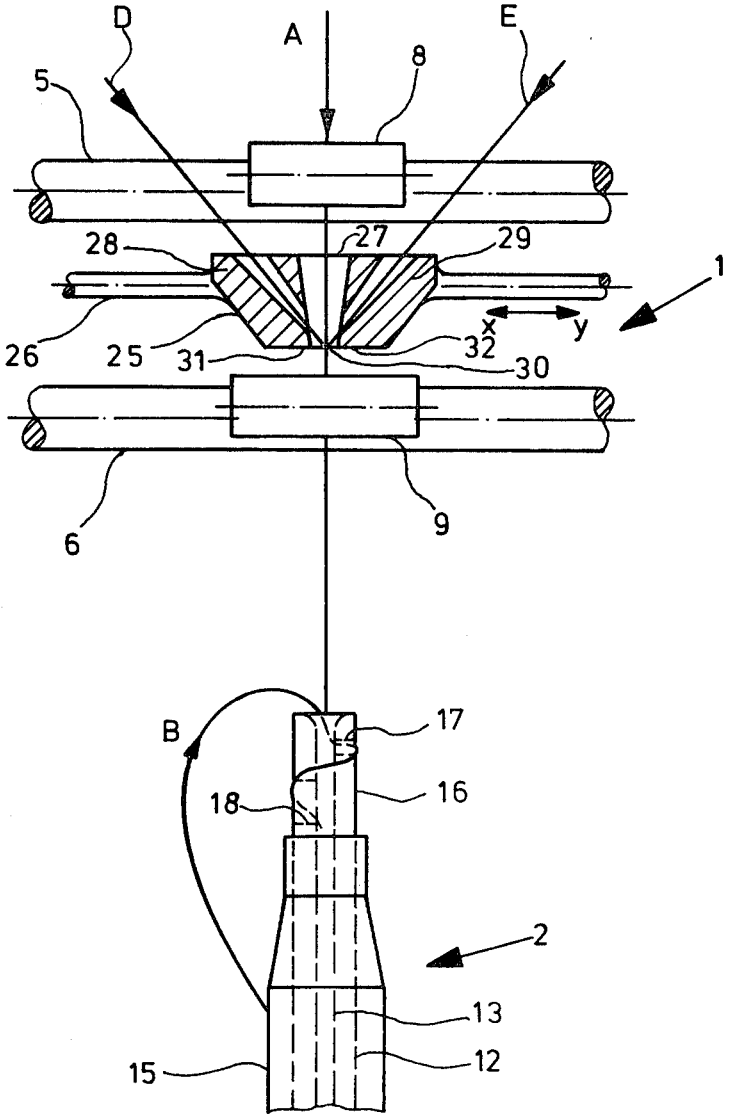
FIG. 2 is a partial schematic elevational view, partly in cross section, of a wrapped spinning aggregate in accordance with the present invention with a feed device for more than one endless yarn.

In the embodiment according to FIG. 2, an inlet funnel 25 is provided upstream of the guide roller pair 6, 9 which leads to the hollow spindle 12. The inlet funnel 25 includes a central channel 27 for the sliver A which tapers in the travelling direction. Additionally, the inlet funnel 25 includes channels 28 and 29 also terminating preferably in the central channel 21, by way of which one endless yarn D and one endless yarn E each are fed. In this manner, the sliver A and the endless yarns D and E are fed to the guide roller pair 6 and 9 aligned accurately to one another. A rod 26 aligned parallel to the axial direction of the guide roller pair 6, 9 is connected to the inlet funnel 25, which is actuated in a conventional manner, not illustrated in detail, to carry out a changing movement in the direction of the double arrow x, y. It is achieved therewith that all yarn components, i.e., the sliver or roving A and the endless yarns D and E are fed to the guide roller pair 6, 9 in a changing movement so that the wear at the guide roller pair 6 and 9 can be kept low.

Figure 3:
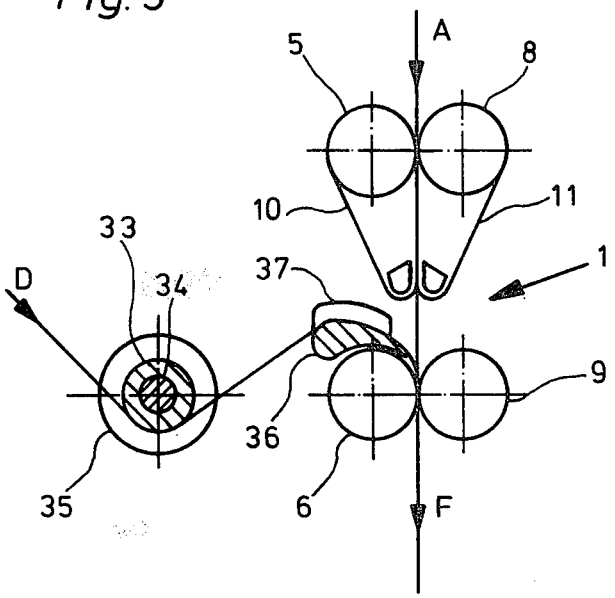
FIG. 3 is a schematic partial view of a wrapped spinning aggregate in accordance with the present invention with a mechanical device for opening an endless yarn fed to the sliver.
Figure 4:
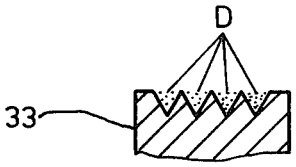
FIG. 4 is a cross-sectional view, on an enlarged scale, illustrating a detail of the apparatus of FIG. 3.

In the embodiment according to FIGS. 3 and 4, a device for the opening of the endless yarn D is provided which opens the endless yarn D mechanically. Also, in this case, the endless yarn D is fed to the guide roller pair 6, 9 independently of the sliver A so that a yarn tension suitable for the opening can be maintained which should be higher with a mechanical opening element than with a pneumatic element. A separator roller 33 serves as opening device, by way of which the endless yarn D is guided under deflection of its travel direction. This separator roller 33 which may be arranged upright or which may include a rotary drive, includes a comb-like grooving (FIG. 4) whereby the individual filament groups are distributed over the grooves. This distribution can be undertaken manually during the insertion of the endless yarn D into the wrapped spinning aggregate. The endless yarn D is guided between the separator roller 33 and the feed roller pair 6, 9 in the opened condition, for which purposes an inlet funnel 36 is provided directly upstream of the feed location to the sliver A, which inlet funnel includes a guide surface limited by an edge hemmer 37 which is appropriately grooved corresponding to the guide surface of the separator roller 33. The separator roller 33 is thereby arranged on a shaft 34 and is provided with a boundary edge 35. In lieu of a grooving, guide elements may also be provided which are equipped correspondingly with needles or teeth or the like.

While we have shown and described several embodiments in accordance with the present invention, it is understood that the same is not limited thereto, but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A method for manufacturing a wrapped yarn from a sliver and at least one endless yarn and a binding thread winding about both the sliver and the endless yarn, comprising the steps of combining the sliver and the endless yarn travelling at substantially the same velocity and substantially parallel to one another, subsequently exposing the same together to only a false twist and wrapping the same with the binding thread.

2. A method according to claim 1, further comprising the steps of opening up the endless yarn into individual filaments or filament groups prior to combining the same with the sliver and combining the sliver and endless yarn with the endless yarn in opened condition.

3. A method according to claim 2, in which at least two differently pretreated endless yarns are combined with the sliver which prior to the combining with the sliver are pretreated differently.

4. A wrapped yarn made according to the method of claim 1, characterized in that the proportion of endless yarn(s) amounts to between about 45 to about 75% by weight.

5. A method according to claim 1, in which at least two differently pretreated endless yarns are combined with the sliver which prior to the combining with the sliver are pretreated differently.

6. A wrapped yarn according to claim 5, characterized in that the proportion of binding thread is less than 5% by weight.

7. An apparatus for manufacturing a wrapped yarn, comprising feed means for a sliver and at least one feed means for an endless yarn, a hollow spindle means provided with false-twist imparting means, said feed means being arranged upstream of the hollow spindle means provided with the false-twist imparting means, as seen in the travelling direction of the yarn components, said hollow spindle means carrying a bobbin with a binding thread rotating in unison therewith, said binding thread travelling together with the sliver and the endless yarn through the hollow spindle means to a take-off means, and further means including a feed roller pair are arranged upstream of the hollow spindle means, as viewed in the travelling direction of the yarn components, said further means being operable to guide and clamp the yarn components in unison, and said hollow spindle means being provided with the false twist-imparting means near its inlet.

8. An apparatus according to claim 7, further comprising a drafting unit arranged upstream of the feed roller pair, as viewed in the travelling direction of the yarn components, as feed means for the sliver.

9. An apparatus according to claim 8, characterized in that the drafting unit has an adjustable draft.

10. An apparatus according to claim 7, characterized in that the common feed roller pair is the last roller pair of a drafting unit for the sliver which is disposed opposite the inlet of the hollow spindle means and to which are fed the endless yarns.

11. An apparatus according to claim 10, characterized in that the drafting unit has an adjustable draft.

12. An apparatus according to claim 7, wherein said further means includes means for changing a property of at least one of the yarn components arranged upstream of the feed roller pair, as viewed in the travelling direction of the yarn components.

13. An apparatus according to claim 7, wherein said further means includes an inlet funnel means for the yarn components is arranged upstream of the guide roller pair.

14. An apparatus according to claim 13, wherein the inlet funnel means is provided with separate channels for the sliver and for each of the endless yarns.

15. An apparatus according to claim 7, wherein said further means includes means for opening each endless yarn into individual filaments or filament groups arranged upstream of the common feed roller pair, as viewed in the travelling direction of the endless yarn.

16. An apparatus according to claim 15, characterized in that the means for opening the endless yarn includes at least one comb-like guide element.

17. An apparatus according to claim 16, characterized in that the guide element includes an edge hammer.

18. An apparatus according to claim 15, characterized in that the means for opening the endless yarn includes a guide element which is equipped with at least one compressed air nozzle directed toward the endless yarn.

19. An apparatus according to claim 18, characterized in that the guide element includes an edge hammer.

20. An apparatus according to claim 15, wherein said further means includes means for changing the property of at least one of the yarn components arranged upstream of the feed roller pair, as viewed in the travelling direction of the yarn components.

21. A wrapped yarn made according to the method of claim 1.

22. A wrapped yarn made in accordance with the method of claim 2.

23. A wrapped yarn according to claim 22, wherein the proportion of endless yarn(s) amount to about 45% to about 75% by weight.

24. A wrapped yarn according to claim 23, wherein the proportion of binding thread is less than 5% by weight.

25. A wrapped yarn consisting of a combination of a sliver component and of a multi-filament yarn component held together by a binding thread, in which the sliver component and the multi-filament yarn component are substantially devoid of any twist, and the binding thread is considerably thinner than the two other components of the wrapped yarn.

26. A wrapped yarn according to claim 25, in which the multi-filament yarn component is substantially in the center area of the wrapped yarn and is surrounded by the sliver component.

* * * * *